United States Patent [19]

Dussault et al.

[11] 4,122,887

[45] Oct. 31, 1978

[54] FLEXIBLE CURTAIN

[75] Inventors: Edmund J. Dussault, Shirley; August J. Kochis, Concord; Arthur A. Cross, Arlington, all of Mass.

[73] Assignee: Eckel Industries, Inc., Cambridge, Mass.

[21] Appl. No.: 799,949

[22] Filed: May 24, 1977

[51] Int. Cl.[2] ..... A47H 23/00

[52] U.S. Cl. ..... 160/354

[58] Field of Search ..... 160/354, 327; 49/9, 49/34

[56] References Cited

U.S. PATENT DOCUMENTS

| | | | |
|---|---|---|---|
| 2,827,117 | 3/1958 | Bateman | 160/327 |
| 3,384,996 | 5/1968 | Gilchrist et al. | 160/354 |

*Primary Examiner*—Peter M. Caun

*Attorney, Agent, or Firm*—Schiller & Pandiscio

[57] ABSTRACT

An automatic closure is disclosed which is adapted to block the flow of air through a door opening. The closure comprises a pliant curtain supported by its upper edge and by a portion of one side edge. The curtain includes a pocket which contains a bracing panel supported by the flanges of a pair of mutually perpendicular split sleeves. The sleeves are secured to a rotatable post, which normally assumes a preferred rotational position corresponding to the air-blocking position of the curtain in the door opening. The curtain, which also carries weights to facilitate its movement into and out of the latter position, is readily installed on, or removed from, its supporting structure.

8 Claims, 6 Drawing Figures

FIG. 2
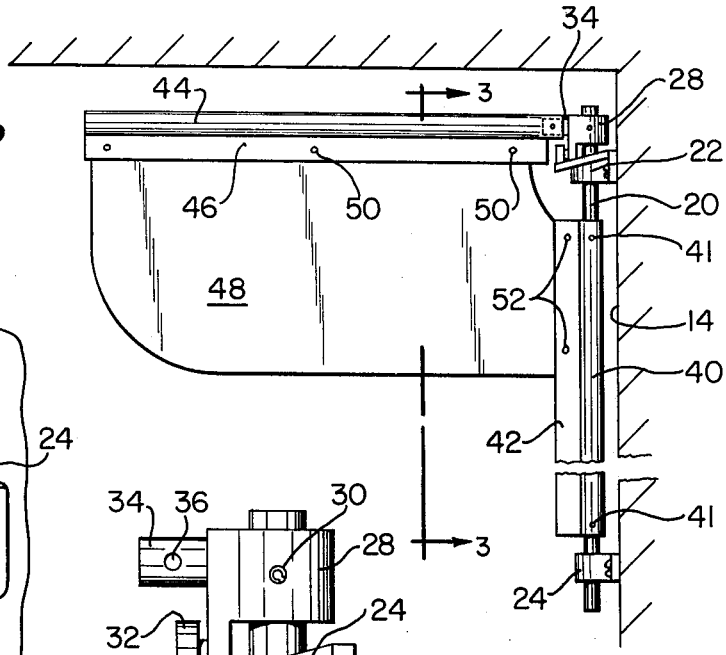
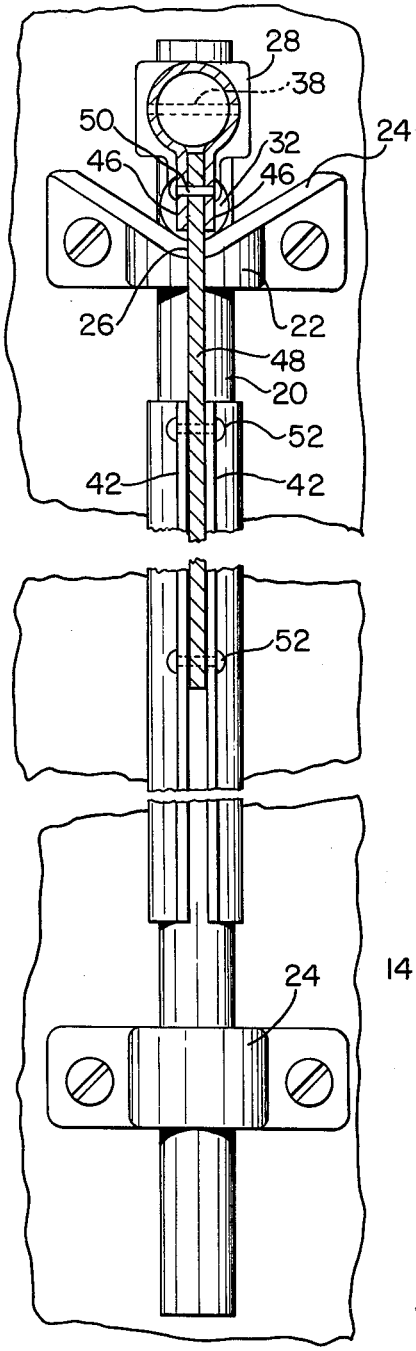
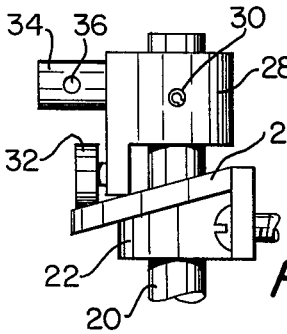
FIG. 4
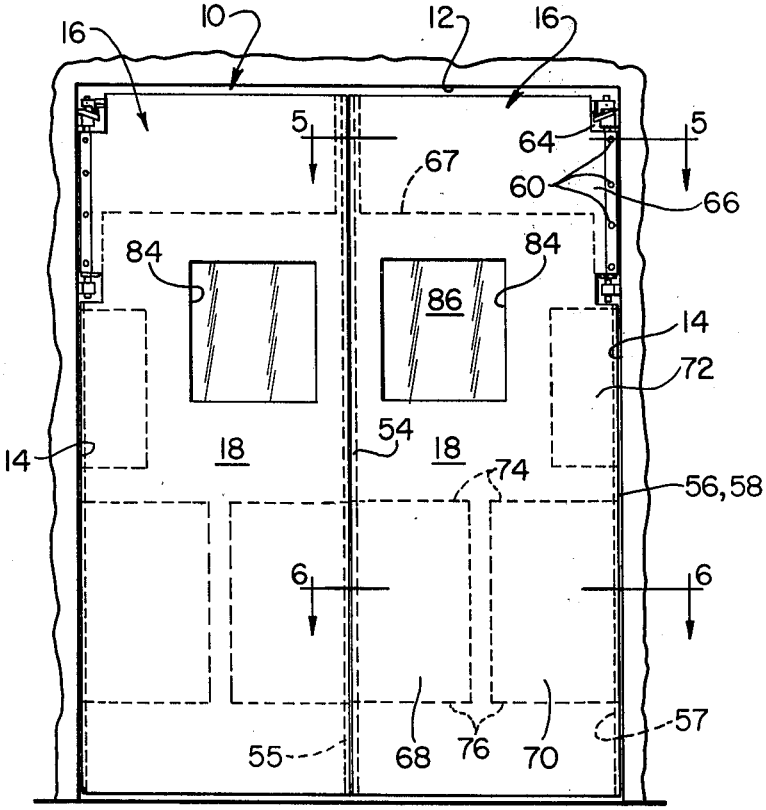
FIG. 3
FIG. 1

FLEXIBLE CURTAIN

BACKGROUND OF THE INVENTION

The present invention relates in general to new and improved automatic closures, in particular to a closure which uses a pliant curtain to block the flow of air through a door opening.

Self-closing doors are well known in the art. For certain types of applications adjacent areas need to be isolated from each other, primarily for the purpose of limiting the passage of air therebetween, e.g. where such air may carry fumes and odors, or where it is desired to block the flow of air for the purpose of slowing down temperature equalization between the two areas.

One of the required attributes of self-closing doors is that the doorway in which they are used be easily cleared in order to allow traffic between the two areas, e.g. to permit the passage of people or loaded carts and dollies in either direction through the doorway. Prior art automatic closures which serve the primary purpose of blocking the transfer of air through a door opening frequently employ a solid door. For the purpose intended, the latter type of construction is more permanent, and hence costlier than is warranted under the circumstances. Further, since such closures sustain frequent damage as a result of load traffic in both directions, they need to be frequently replaced. The true cost of such a replacement includes not only the expense of the door alone, but also the cost of removing and replacing a relatively permanent structure.

Although the prior art has recognized that curtains of the proper material adequately serve the purpose of blocking the passage of air through a door opening, satisfactory closures employing such curtains have not been available heretofore. In general, existing arrangements using air-blocking curtains employ two curtain halves fastened to the lintel above the doorway in partially overlapping relationship down the center of the doorway. People and loads transiting the doorway pass between the curtain halves by spreading apart the overlapping curtain portions.

Such an arrangement is unsatisfactory for a number of reasons, primary among which is the fact that it provides a poor air barrier. Inevitably a gap is formed between the two halves through which air can pass. Further, air drafts or the like can readily waft aside the relatively light weight curtain material so as to unblock large portions of the doorway.

Further, if the two curtain halves are affixed to the lintel in a manner where they overlap at the center of the doorway, the curtain will not part easily in its upper portion. Thus, tall objects passing through the doorway often encounter resistance from the curtain. Under these conditions, the possibility of damage to the curtain, particularly in the vicinity of the lintel where the strain on it is likely to be high, is greatly enhanced.

Since the curtain is usually permanently fastened to the lintel in the arrangement described, its replacement, once damaged often consumes an undue amount of time. Thus, heretofore available air barrier curtains are not only prone to damage, but their cost is effectively increased due to the difficulty encountered in replacing and installing them.

OBJECTS OF THE INVENTION

Accordingly, it is a primary object of the present invention to provide an automatic closure which is not subject to the foregoing disadvantages.

It is another object of the present invention to provide a self-closing door wherein a pliant curtain returns to its air-blocking position upon displacement from the latter.

It is a further object of the present invention to provide a self-closing door which employs a pliant curtain that may be readily and inexpensively installed and removed.

It is still another object of the present invention to provide a self-closing door using a pliant curtain wherein the possibility of damage from traffic through the doorway is minimized.

These and other objects of the present invention together with the features and advantages thereof will become apparent from the following detailed specification when read in conjunction with the accompanying drawings.

BRIEF DESCRIPTION OF THE DRAWINGS

FIG. 1 illustrates a preferred embodiment of the invention which employs a double door;

FIG. 2 illustrates certain structural details of the apparatus of FIG. 1;

FIG. 3 is a cross-sectional view of the apparatus of FIG. 2 taken at line 3—3;

FIG. 4 illustrates a further detail of the apparatus of FIG. 2;

With reference now to the drawings, FIG. 1 illustrates a pair of substantially identical doors constructed in accordance with the present invention to block the passage of air through a doorway 10. The doorway includes a lintel 12 and a pair of door jambs 14. Since the two doors are identical, the description hereafter is limited to one door only. It will be understood, however, that the invention is not limited to a double door closure and that it is similarly applicable to a doorway wherein a single self-closing door is employed.

Figure 5:
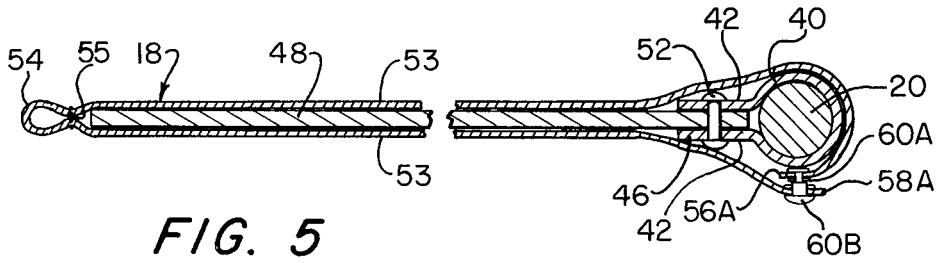
FIG. 5 is a cross-sectional view of the apparatus of FIG. 1 taken at line 5—5.

The door, which is generally indicated by reference numeral 16, comprises a curtain 18 which extends substantially the full height of opening 10. A post 20, best shown in FIGS. 2 to 4, is rotatably supported in a pair of bearings 22 and 24 which are vertically spaced from each other and so fastened to the upper portion of door jamb 14. Bearings 22 and 24 also permit sliding motion of post 20 in an axial direction.

Bearing 22, which may be identical to the corresponding bearing shown in U.S. Pat. No. 3,384,996, includes an integral cam track 24 which has a low point, as indicated by reference numeral 26. A cam follower 28 is secured to post 20 by means of a pin 30 so as to rotate therewith. Cam follower 28 includes a roller 32 which is positioned to ride on cam rack 24 and to return to position 26 in the absence of a force moving it out of the latter position. Cam follower 28 further includes a boss 34 which is integral with the cam follower. The axis of boss 34 is substantially perpendicular to that of post 20. Boss 34 further includes a bore 36, which is adapted to be engaged by a pin 38.

A split sleeve 40 is coaxially disposed on post 20 and is secured thereto by means of pins 41 so as to rotate therewith. Sleeve 40 includes a pair of substantially parallel flanges 42 which are substantially coextensive in length with the sleeve. A further split sleeve 44 is coaxially mounted on boss 34 and is fastened thereto by means of the aforesaid pin 38. Sleeve 44 similarly includes a pair of substantially parallel flanges 46 which are substantially coextensive in length with sleeve 44.

Flange pairs 42 and 46 define a plane between them in which a flat, thin bracing panel 48 is positioned. The bracing panel, which preferably consists of a relatively stiff plastic, includes a pair of mutually perpendicular edges which are positioned between flanges 42 and 46 respectively and which are at least partially coextensive with the latter. Flanges 46 are fastened to panel 48 by means of rivets 50 which are spaced at intervals along the corresponding horizontal panel edge. Similarly, flanges 42 are fastened to panel 48 by means of rivets 52 which are spaced along the corresponding vertical panel edge. In a preferred embodiment of the invention panel 48 is shaped to provide clearance for bearing 22 and cam follower 28. The diagonally opposite panel corner is preferably rounded off.

Figure 6:
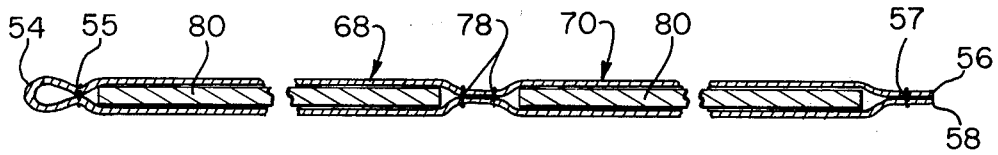
FIG. 6 is another cross-sectional view of the apparatus of FIG. 1 taken at line 6—6.

As best seen from FIGS. 5 and 6, curtain 18 comprises a pair of layers 53 of a preferably pliant material which is folded on itself to provide a pliant bulbous edge 54 which runs the full length of the curtain. Curtain 18 is preferably made of a single sheet of material and preferably the two layers are secured together, as shown at 55, by stitching or cement or other suitable means, so as to provide dimensional stability to bulbous edge 54. Edge 54 is adapted to coact with the corresponding edge of the opposite curtain shown in FIG. 1 to form a resilient air seal. Alternatively, where a single door arrangement is used, edge 54 may be in sealing contact with the adjacent jamb of the door opening. The two layers terminate in a pair of edges 56 and 58 which are disposed adjacent door jamb 14 and which extend substantially parallel thereto. Edges 56 and 58 similarly run the full length of the curtain, except where the curtain is recessed to accomodate bearings 22 and 24 (FIG. 1).

Except as otherwise indicated hereinafter, the layers 53 of the curtain are secured together (by stitching, cement or other means) as shown at 57 adjacent the edges 56 and 58. As shown in FIG. 5, in the region of sleeve 40 the edges 56 and 58 are free, i.e., separable from one another and at least one layer of the curtain is wider than it is below sleeve 40 to permit it to wrap around that sleeve. The free edges of the layers 53 along the length of sleeve 40 are identified by numerals 56A and 58A respectively. These free edges envelop sleeve 40 as shown in FIG. 5 and are fastened together in that position by conventional snap means identified generally by numeral 60 (FIG. 1) comprising cooperating male and female snap elements 60A and 60B attached to the free edge sections 56 and 58 respectively (see FIG. 5). A cutout 64 in the curtain assures that the aforesaid wrap-around arrangement leaves bearing 22 and cam follower 28 exposed.

A pocket 66 is formed by layers 53 of curtain 18, by means of stitching or the like represented at 67, which is adapted to contain the aforesaid split sleeves 40 and 44 and panel 48 therein. The arrangement so provided readily facilitates the installation of removal of the curtain. More specifically, when snap elements 60A and 60B are undone and free curtain edges 56A and 58A are open, pocket 66 may be slid onto sleeve 44, bracing panel 48 and sleeve 40, until the free edges reach around sleeve 40. When snaps 60 are closed, the curtain is securely held in place. The procedure is reversed to remove the curtain.

Curtain 18 further includes a plurality of pockets 68, 70 and 72, formed by stitching or the like, each of which contains a flat, thin weight. The purpose of the weights is to provide inertia when the closure is opened or when it is returned to its closed position, so as to facilitate these operations and to assist the closure in responding as a unit when a torque is applied thereto.

The cross-sectional view of FIG. 6 illustrates the aforesaid arrangement. Pockets 68 and 70 are defined by seams 55, 57, 74, 76 and 78 and they each contain a weight 80. A similar weight (not shown) is in pocket 72. The weights may consist of unbreakable plastic or metal, so as to withstand the impact of a loaded dolly or the like without breaking. Each weight is preferably (but not necessarily) glued to the walls of the pocket in which it is disposed so as to confer unity of movement to all parts of the curtain when the closure is in motion.

In a preferred embodiment of the invention curtain 18 further includes a window cut-out 84 in which a transparent single layer of pliant material 86 is disposed. Window 86 is preferably made of an impact-resistant plastic and is secured in place by a suitable adhesive, or by stitching extending through the pliant curtain layers 53 and also the window. The window provides a view of persons or loads entering the doorway from the opposite direction.

In operation, the presence of the weights in pockets 68, 70 and 72 will cause pliant curtain 18 to block substantially one half of doorway 10 (or to block the full doorway where a single door is used), by causing the curtain to hang relatively straight when the closure is in its normal position and by resisting being wafted aside by air drafts. Persons passing through the doorway, or loads such as dollies being pushed or pulled through, cause force to be applied to the curtain. The force is transmitted to split sleeves 44 and 40 by way of bracing panel 48 which is held between the flanges of these sleeves. As a consequence, a torque is developed which causes post 20 to rotate in its bearings, together with the attached sleeves.

The action of the curtain during this operation differs, depending on the curtain area to which force is applied. If the force is applied near the vertical midpoint of the curtain, i.e. above pockets 68 and 70 as may be the case when a person pushes against the curtain upon passing through the doorway, the curtain will at first yield in the direction of force application. However, the tension maintained by the weights in the pockets will cause the force to be transmitted to bracing panel 48 and to post 20 in the manner described above. The weights in the pockets, which are caused to move in the direction of force application, will at first lag the forward movement of the bracing panel, particularly if the force is applied suddenly. However, as their momentum builds up the weights may overtake the bracing panel, such that the lower curtain half leads the movement of the curtain out into the open position.

Force may also be intitially applied to the curtain in the area of pockets 68 and 70, as would be the case when a loaded dolly impacts the curtain. In the latter case, the momentum imparted to the weights by the impact will cause the lower curtain half to lead the upper curtain half throughout the movement of the curtain out of its blocking position.

The return movement of the door is initiated by the action of roller 32 which seeks out its preferred position on cam track 24. This action rotates cam follower 28, as well as post 20 to which the cam follower is secured, back to their original position. The torque so applied to post 20 is transmitted to curtain 18 by way of split sleeves 40 and 44 respectively and bracing panel 48 which is held between the flanges of the aforesaid sleeves. Accordingly, during the return movement of the curtain the upper curtain half at first leads the lower half. However, as the momentum of the weights builds up, the lower curtain half may again overtake the upper half and lead the movement of the curtain back to the closed position.

From the foregoing explanation, it will be clear that the invention lends itself to a number of variations within the general scope thereof. For example, although post 20 and flange 40 are preferably short with respect to the full length of the curtain, the invention is not so limited and these components may be lengthened up to the full height of the door opening. Such added length serves a purpose only if additional bracing panels or ribs are inserted transversely of the curtain further down the length thereof and if these additional components are held by flanges 42 so that torque can be directly transmitted.

However, in accordance with the present invention it is preferable to maintain sleeve 40 and post 20 as short as possible in order to limit the cost of the overall closure, to provide maximum clearance in doorway 10, and to facilitate the installation and removal of curtain 18.

Bracing panel 48 preferably consists of a strong, relatively stiff plastic which is held between the flanges of sleeves 40 and 44. However, other types of materials are feasible, provided they give strength to the panel without an undue amount of weight. The weights contained in pockets 68, 70 and 72 preferably consist of an impact-resistant, semi-rigid plastic, although different materials such as metal are also feasible. The number and locations of the pockets may vary, depending on the particular requirements of each situation. The curtain itself preferably consists of a pliant plastic sheet, or of an impregnated fabric impervious to the passage of air.

From the foregoing explanation it will be apparent that numerous modifications, variations and substitutions will now occur to those skilled in the art, all of which fall within the spirit and scope contemplated by the present invention. Accordingly, the invention is intended to be limited only by the scope of the appended claims.

What is claimed is:

1. A closure apparatus comprising:

a vertical post;

means for rotatably mounting said post;

a first split sleeve coaxially mounted on said post so as to rotate therewith;

a second split sleeve positioned at right angles to said post and mounted to rotate therewith;

each of said sleeves including a pair of substantially parallel flanges, each of said flange pairs being substantially coextensive in length with its corresponding sleeve;

a flat bracing panel including first and second mutually perpendicular edges positioned between the flanges of said first and second sleeves respectively, said panel edges being at least partially coextensive with the length of the corresponding flange pairs, said flange pairs being fastened to said panel at spaced points along said edges;

a curtain including a pliant material folded on itself into at least a pair of layers and terminating in a pair of free edges opposite the fold of said material substantially parallel to said post;

said layers being formed into a pocket closed at the top and open at said free curtain edges and adapted to receive said second sleeve and said flat bracing panel;

said curtain being disposed so that said second sleeve and said bracing panel extend into said pocket; and cooperating snaps disposed on said free curtain edges for removably fastening said free curtain edges around said first sleeve and said post.

2. Apparatus according to claim 1 wherein said mounting means comprises a pair of bearings spaced from each other;

one of said bearings including a cam track integral therewith;

a cam follower secured to said post, said cam follower including a roller positioned to ride on said cam track and adapted to return to a preferred position on said track when displaced therefrom;

a boss integral with said cam follower and including an axis perpendicular to said post; and means for coaxially securing said second sleeve to said boss.

3. Apparatus according to claim 2 wherein said fold forms a pliant, bulbous curtain edge substantially parallel to said free curtain edges and spaced thereform substantially by the length of said second sleeve, the length of said curtain in the direction of said curtain edges exceeding the length of said first sleeve at least by a factor of two;

said layers being permanently joined together around the border of said curtain except in the vicinity of said snaps.

4. Apparatus according to claim 3 wherein said layers form at least one further pocket positioned below the level of said first sleeve; and a flat, substantially planar weight positioned in said further pocket.

5. Apparatus according to claim 4 wherein said weight is adhesively secured to the walls of said further pocket.

6. Apparatus according to claim 3 wherein said curtain includes at least one window cutout positioned above said further pocket; and a layer of transparent, pliant material secured in said cutout.

7. In a self-closing door for a door opening which includes a door jamb and a lintel, apparatus comprising:

first and second bearings secured to the upper portion of said door jamb vertically spaced from each other, said first bearing being positioned substantially adjacent said lintel;

a post rotatably disposed in said bearings and positioned substantially parallel to said door jamb;

a first split sleeve coaxially mounted on said post and secured thereto so as to rotate therewith, said first sleeve including a pair of parallel flanges substantially coextensive in length with said sleeve;

said first bearing including a cam track integral therewith;

a cam follower secured to said post and adapted to rotate therewith, said cam follower including a roller positioned to ride on said track and adapted to assume a preferred position thereon;

a boss integral with said cam follower and including an axis substantially perpendicular to said post;

a second sleeve coaxially mounted on said boss so as to rotate therewith, said second sleeve being substantially parallel to said lintel and proximate the latter when said roller is in said preferred track position;

a flat bracing panel including first and second mutually perpendicular edges positioned between the flanges of said first and second sleeves respectively, said panel edges being at least partially coextensive with the length of the corresponding flange pairs, said flange pairs being secured to said panel at spaced points along said edges;

a curtain including a pliant material folded on itself into at least a pair of layers, the fold of said curtain forming a pliant bulbous curtain edge substantially parallel to a pair of free curtain edges and spaced from the latter substantially by the length of said second sleeve, the length of said curtain being substantially coextensive with the length of said door jamb;

said layers being stitched together to form a first pocket open at one end and adapted to receive said sleeves and said bracing panel therein;

snap means disposed on said free curtain edges adapted to removably fasten the latter around said first sleeve;

said layers being stitched together around the border of said curtain except in the vicinity of said snaps;

a plurality of further pockets stitched into the lower portion of said curtain; and a flat substantially planar weight disposed in each of said further pockets, each of said weights being adhesively secured to the walls of the pocket in which it is disposed.

8. Apparatus according to claim 7 wherein said curtain includes at least one window cut-out positioned below said first pocket; and a panel of pliant transparent material stitched into said cut-out.

* * * * *